US007931268B2

(12) United States Patent
Chagnon et al.

(10) Patent No.: US 7,931,268 B2
(45) Date of Patent: Apr. 26, 2011

(54) DEVICE FOR BRAKING FLAT PRODUCTS AND CORRESPONDING FOLDER

(75) Inventors: Franck Chagnon, saint Leu d'Esserent (FR); Philippe Herda, Nogent sur Oise (FR); Thierry Melon, Breuil le Vert (FR); Jérôme Peres, Montataire (FR); Eric Pierda, saint Leu d'Esserent (FR); Jean-François Robert, Creil (FR); Philippe Robin, Cires-les-Mello (FR); Thierry Vauchelle, Maignelay Montigny (FR)

(73) Assignee: Goss International Montataire SA, Montataire (FR)

( * ) Notice: Subject to any disclaimer, the term of this patent is extended or adjusted under 35 U.S.C. 154(b) by 272 days.

(21) Appl. No.: 12/215,172

(22) Filed: Jun. 25, 2008

(65) Prior Publication Data

US 2009/0008870 A1 Jan. 8, 2009

(30) Foreign Application Priority Data

Jun. 28, 2007 (FR) ..... 07 56108

(51) Int. Cl.
*B65H 29/68* (2006.01)

(52) U.S. Cl. ..... 271/182; 271/229; 271/273; 271/270

(58) Field of Classification Search ..... 271/182, 271/229, 270, 273
See application file for complete search history.

(56) References Cited

U.S. PATENT DOCUMENTS

| | | | | |
|---|---|---|---|---|
| 3,507,489 | A * | 4/1970 | Bennett et al. | 271/182 |
| 5,050,856 | A * | 9/1991 | Parigi et al. | 271/182 |
| 5,168,290 | A * | 12/1992 | Tanaka et al. | 346/134 |
| 5,417,416 | A * | 5/1995 | Marmin et al. | 271/270 |
| 5,599,012 | A * | 2/1997 | Rebeaud | 271/182 |
| 6,315,287 | B1 * | 11/2001 | Hirth et al. | 271/182 |
| 6,398,211 | B1 | 6/2002 | Schalk | |

FOREIGN PATENT DOCUMENTS

| | | |
|---|---|---|
| DE | 199 21 169 | 11/2000 |
| EP | 0 639 523 | 2/1995 |
| FR | 2 793 229 | 11/2000 |
| GB | 288456 | 4/1928 |
| GB | 654338 | 6/1951 |
| GB | 1 343 303 | 1/1974 |
| WO | WO2005/082757 | 9/2005 |

* cited by examiner

*Primary Examiner* — Stefanos Karmis
*Assistant Examiner* — Luis Gonzalez
(74) *Attorney, Agent, or Firm* — Davidson, Davidson & Kappel, LLC

(57) ABSTRACT

This device for braking a flat product, in particular a signature, has a support, a brake shoe for braking the flat product, the brake shoe being movable between a position allowing the passage of the flat product and a position effecting braking of the flat product, and a drive for driving the brake shoe from the passing position towards the braking position.
The drive includes an eccentric element which is movable in rotation and co-operates with the brake shoe.

16 Claims, 4 Drawing Sheets

DEVICE FOR BRAKING FLAT PRODUCTS AND CORRESPONDING FOLDER

This claims the benefit of French Patent Application No. 07 56108, filed on Jun. 28, 2007 and hereby incorporated by reference herein.

BACKGROUND OF THE INVENTION

The invention is applicable in particular to folders of offset rotary presses.

Such a device for braking a flat product is known from the document FR-A-2 793 229.

This device uses an electromagnet in order to move the brake lining from its passing position towards its braking position.

However, electromagnets are not very reliable.

Consequently, the object of the invention is to increase the reliability of the braking device, in particular when production rates are high.

SUMMARY OF THE INVENTION

To this end, the present invention provides a braking device characterised in that the driving means comprise an eccentric element which is movable in rotation and co-operates with the brake shoe.

The present invention provides a device for braking a flat product, in particular a signature, of the type comprising:

a support, a brake shoe for braking the flat product, the said brake shoe being movable between a position allowing the passage of the flat product and a position effecting braking of the flat product, means for driving the brake shoe from its passing position towards its braking position.

According to particular embodiments of the invention, the braking device may include one or several of the following features:

the eccentric element is movable in rotation in particular between a passing position corresponding to the passing position of the brake shoe and a braking position corresponding to the braking position of the brake shoe, and the brake shoe is freely movable between its passing position and its braking position when the eccentric element is in its passing position;

the brake shoe has a braking face directed towards the flat product to be braked in the installed state and an actuating face disposed opposite the braking face, and the eccentric element co-operates with the actuating face;

the brake shoe has a basic body and a wear component, and the wear component is in contact with the eccentric element;

the wear component is made from a softer material than the eccentric element, and is in particular made from bronze;

the braking device includes means for returning the brake shoe towards its passing position, in particular a spring;

the returning means includes a leaf spring fixed to the brake shoe and to the support; and the braking device includes means for driving the eccentric element in rotation, in particular a motor and a cardan joint connection.

The invention also provides a folder, in particular a chopper folder including a folding table and a device for braking flat products to be folded arriving on the folding table, characterised in that the braking device is provided with a braking device as defined above.

According to a particular embodiment, the folder is characterised in that the braking device includes means for controlling the eccentric element which are suitable for braking exclusively the downstream part of a flat product to be folded.

BRIEF DESCRIPTION OF THE DRAWINGS

The invention will be better understood by reading the following description, given solely by way of example and with reference to the appended drawings, in which.

DETAILED DESCRIPTION OF THE PREFERRED EMBODIMENT

Figure 1:
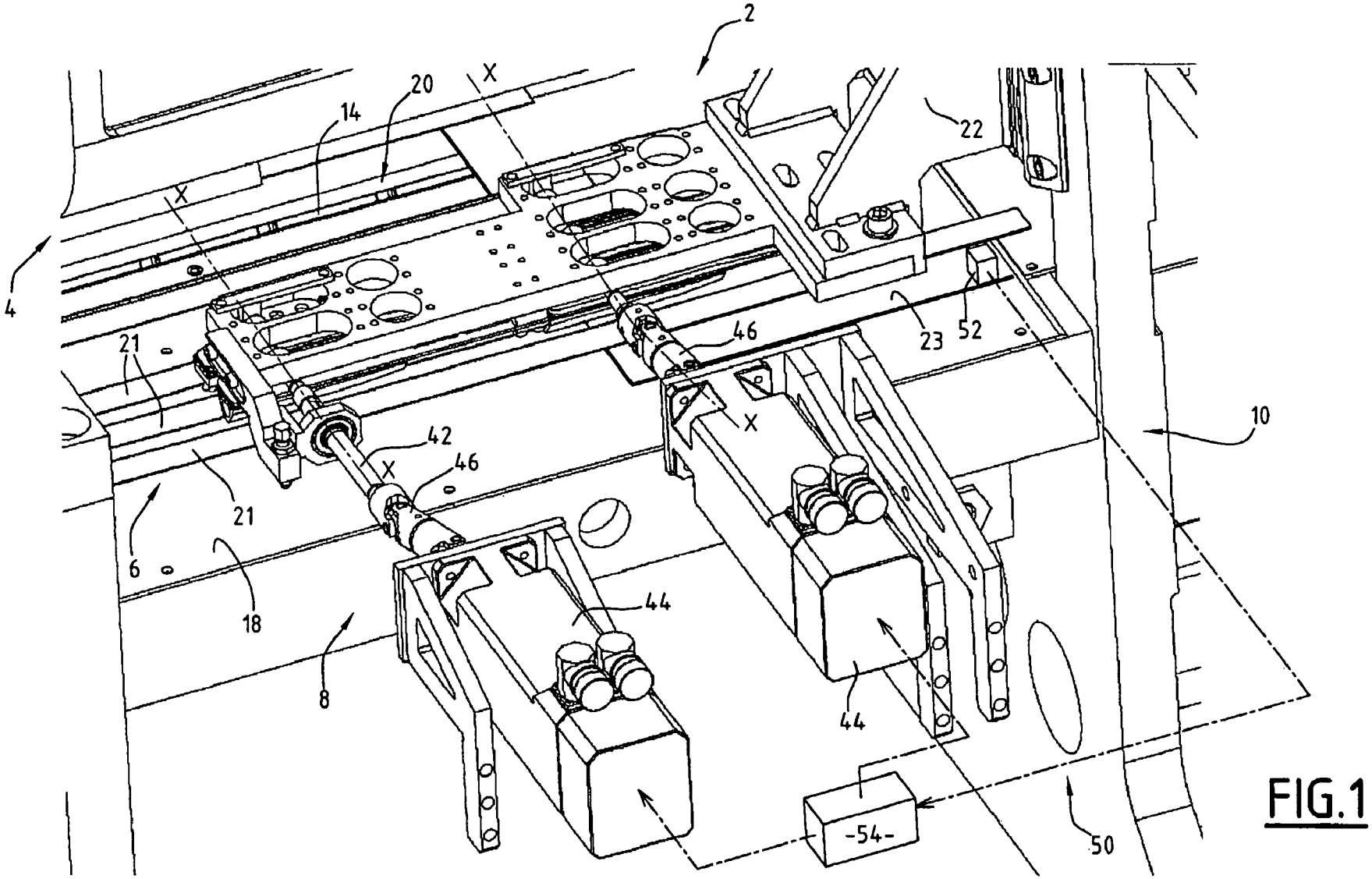
FIG. 1 is a perspective view of a part of a folder provided with a braking device according to the invention.

A part of a folder according to the invention, designated by the general reference 2, is shown in perspective in FIG. 1.

The folder 2 has a chopper folding device 4, means 6 for conveying flat products, for example, a conveyor, as well as a device 8 for braking a flat product. The folder 2 has a stand 10 on which these different components are mounted.

Figure 3:
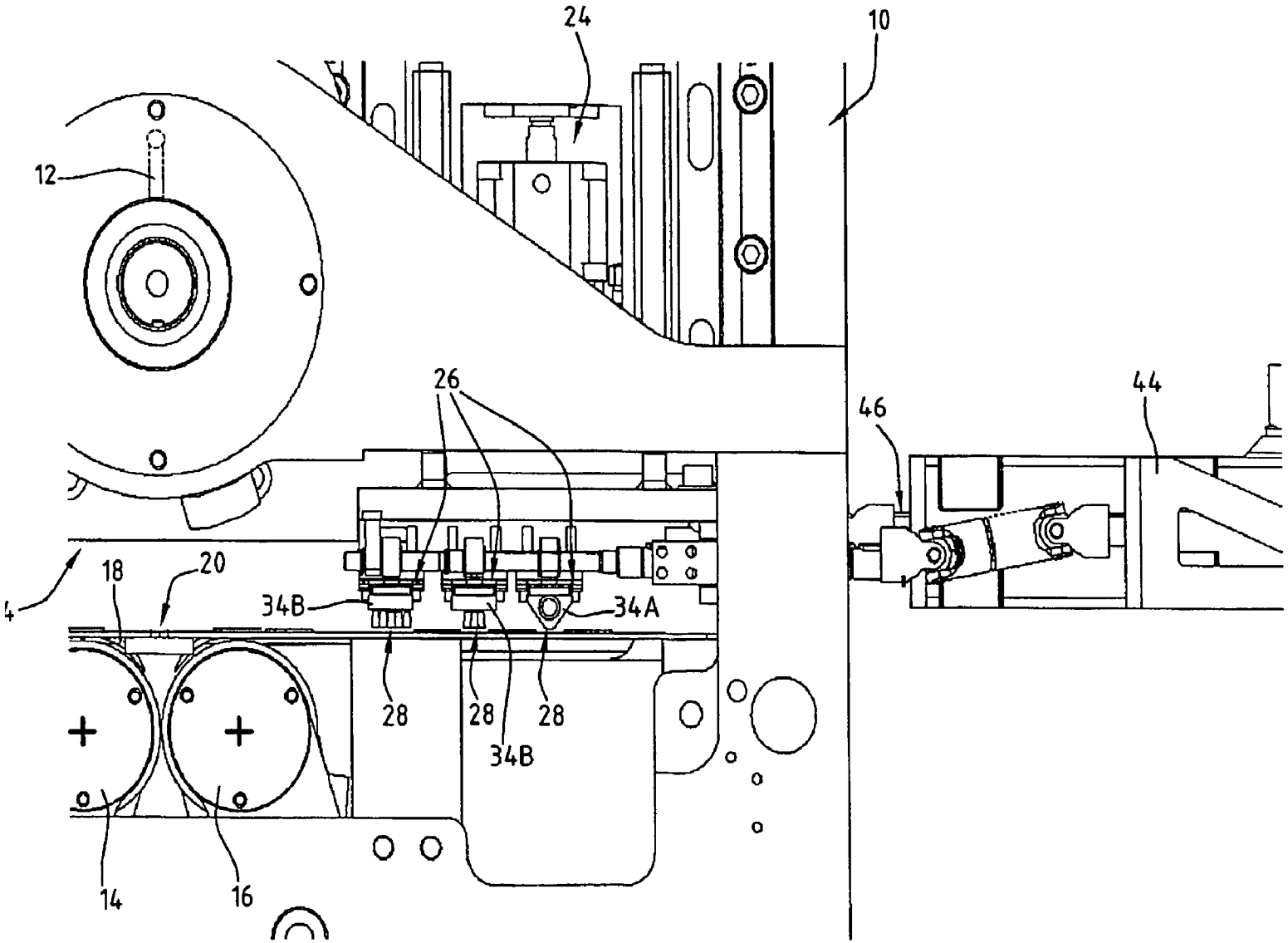
FIG. 3 is a front view of the folder according to FIGS. 1 and 2.

The chopper folding device 4 is provided with a chopper folding blade 12 (see FIG. 3) and also two parallel folding rollers 14, 16. The chopper folding device 4 is also provided with a folding table 18, provided with a folding slot 20. Thus the chopper folding device 4 is suitable for folding a flat product by pushing this flat product through the folding slot 20 by means of the chopper folding blade 12 and by gripping it by means of the folding rollers 14, 16.

The conveying means 6 have parallel belts 21 suitable for conveying a succession of flat products to be folded, such as printed signatures 23 or printed sheets, on the folding table 18.

The braking device 8 is suitable for slowing down or even completely stopping the products to be folded before the folding. The braking device 8 has a support 22 which is movable in translation in a direction perpendicular to the plane of the folding table 18. The support 22 is displaceable for example in a direction perpendicular to the plane of the folding table 18 by means of a jack 24 fixed to the stand 10 (see FIG. 3).

The braking device 8 also has a plurality of brake shoes 26, each of which is movable between a position allowing the passage of the flat product to be folded and a position effecting braking of the flat product. When the brake shoe 26 is located in its position allowing the passage of the flat product, it is further from the surface of the folding table 18 than when it is located in its position effecting braking of the flat product.

In this case the brake shoe 26 has a braking face 28 directed towards the product to be folded 23 or the folding table 18 and an actuating face 30 disposed opposite the braking face 28.

Each brake shoe 26 is composed of a basic body 32, a brake lining 34 and a wear component 36.

The basic body 32 is for example a block of metal, in particular aluminium.

The brake lining 34 forms the braking face 28 and may comprise either a brake pad made from plastics material 34A or a brush 34B. The brushes 34B may have different widths (see FIG. 3), measured transversely with respect to the direction of conveying the flat products.

The wear component 36 is a block which is for example made from bronze and which has a concave friction surface. This friction surface forms the actuating face 30 opposing the braking face 28.

Moreover, the braking device 8 is provided with means for returning the brake shoe 26 to its passing position. These returning means comprise a leaf spring 38, of which a first end is fixed to the support 22 and of which a second end is fixed to the brake shoe 26 and supports the latter. The natural frequency of the leaf 38 is advantageously different from the natural frequency of the rest of the folder. This prevents the brake linings from being excited by the folder during operation.

The braking device 8 also has means for driving the brake shoe 26 from its passing position to its braking position, for example, a drive. These driving means comprise an eccentric element 40 movable in rotation about an axis of rotation X-X. The eccentric element 40 has an external surface 41 having a cross-section in the form of a circle of which the axis is offset from the axis of rotation X-X. In a variant the eccentric element 40 may be replaced by a cam having an external surface 41 with a non-circular cross-section.

Figure 2:
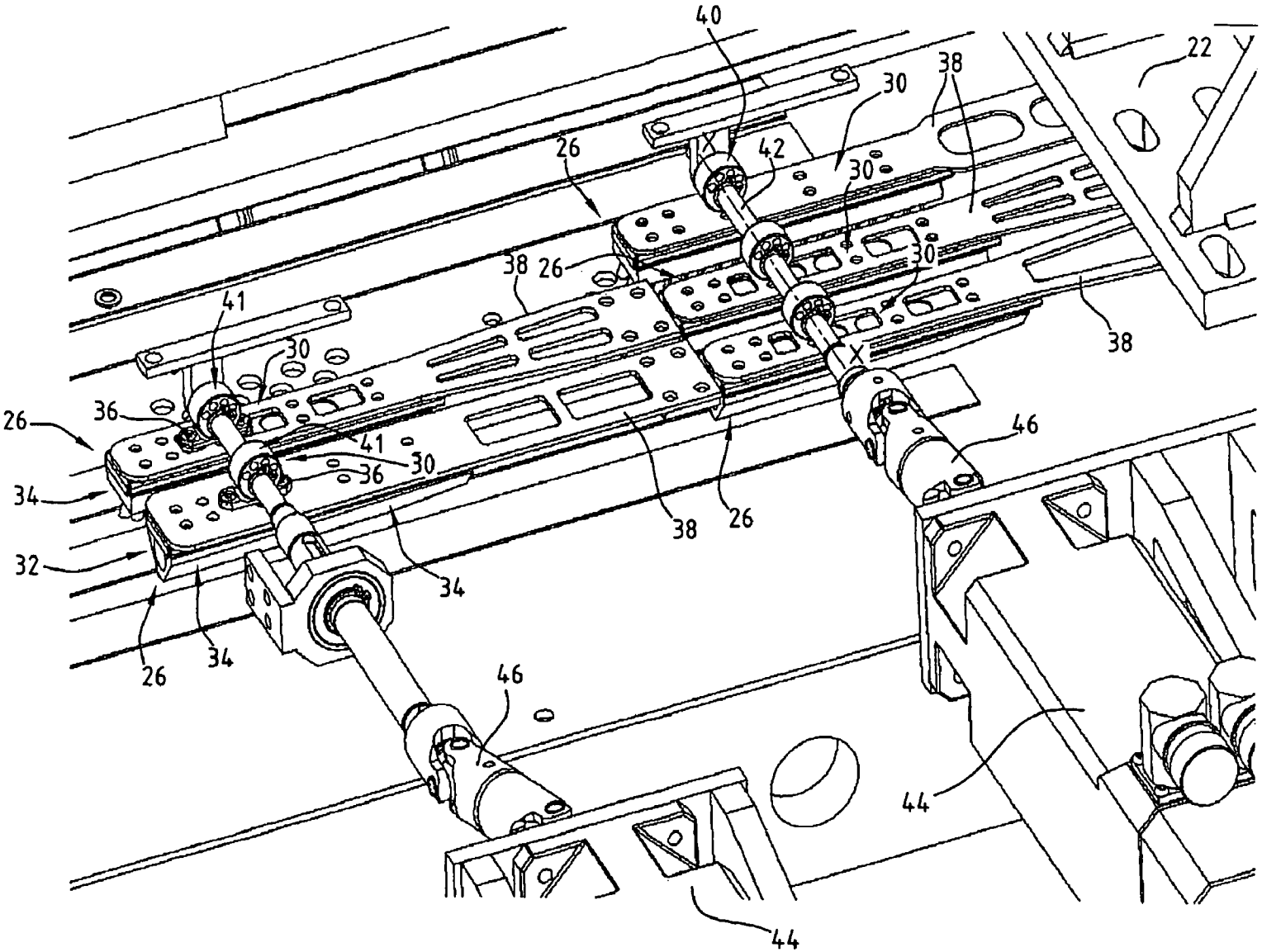
FIG. 2 is a view of a detail of the folder according to FIG. 1, a part of the support being omitted.

The eccentric element 40 is movable in rotation about the axis X-X between a passing position corresponding to the passing position of the brake shoe 26 (see FIG. 2) and a braking position corresponding to the braking position of the brake shoe 26. To this end, the eccentric element 40 is fixed in rotation on a shaft 42 which is itself movable in rotation about the axis X-X. The eccentric element 40 bears freely with its external surface 41 on the friction surface of the wear component 36 in such a way that when the eccentric element 40 is in its passing position, the brake shoe 26 is freely movable from its passing position towards its braking position, distancing the wear component 36 from the eccentric element 40 and in opposition to the returning force of the spring 38.

The eccentric element 40 is made from a harder material than the wear component 36, for example from steel.

The leaf spring 38 keeps the brake shoe 26 in its passing position in the rest state, and returns this brake shoe 26 towards its passing position when it is located in its braking position.

The braking device 8 has means for driving the shaft 42 in rotation. In this case these driving means have, for each shaft 42, an electric motor 44 of which the output shaft is connected by means of a double cardan joint connection 46 to the shaft 42. The double cardan joint connection enables adjustment of the height of the assembly comprising the leaf springs 38, the blade support 22 and the shafts 42, knowing that the motors 44 are fixed to the stand 10. Furthermore, this enables displacement of the brake linings between a supported position and an unsupported position on the folding table 18.

A shaft 42 has at least two eccentric elements 40, each of which co-operates with a wear component 36, and therefore with a brake lining. Thus two or several brake linings can be controlled by one single shaft 42.

Also the shaft 42 is accommodated rotatably on the support 22 but moreover is fixed with respect thereto whilst each motor 44 is fixed to the stand 10.

The folder 2 also has control means 50, for example, a controller, in order to control each motor 44 and consequently the eccentric element 40 so as to be synchronised with the arrival of the flat products to be folded on the folding table 18.

To this end, the control means 50 comprise a sensor 52 which detects the position and/or the speed of the products to be folded 23 and delivers a corresponding signal to a control unit 54. The control unit 54 is connected to each motor 44. Thus the control means 50 are suitable for setting the eccentric element 40 in rotation in such a way that the brake shoes 26 bear exclusively on a downstream part of a flat product to be folded 23. The upstream part of the flat product 23 is not braked by contact with the brake lining 26.

The folder according to the invention is advantageous given that the eccentric elements 40 may be set in rotation at a high speed. Consequently the folder may be driven at high folding speeds of for example 70,000 copies per hour.

The motors 44 are synchronised with a motor for driving the folder 2.

The two motors 44 may be controlled in such a way that the phase of rotation of the eccentric elements 40 associated with a motor 44 is staggered with respect to the phase of rotation of the eccentric elements 40 associated with another motor 44.

This makes it possible to stagger the action of the downstream brake linings with respect to the upstream brake linings.

Equally, two motors 44 may act independently of one another to drive brake linings disposed on either side of the folding blade 12. In this case it is possible to stagger the action of the brake linings situated on either side of the blade 12, in order to straighten the angle of the leaflet. In other words, the variation of the motors 44 of the brake shoes 26 situated on either side of the blade 12 makes it possible to correct the angle of a leaflet which is not perpendicular to the blade 12.

Also, the phasing of the motors 44 with respect to the signatures 23 can be modified.

Figure 4:
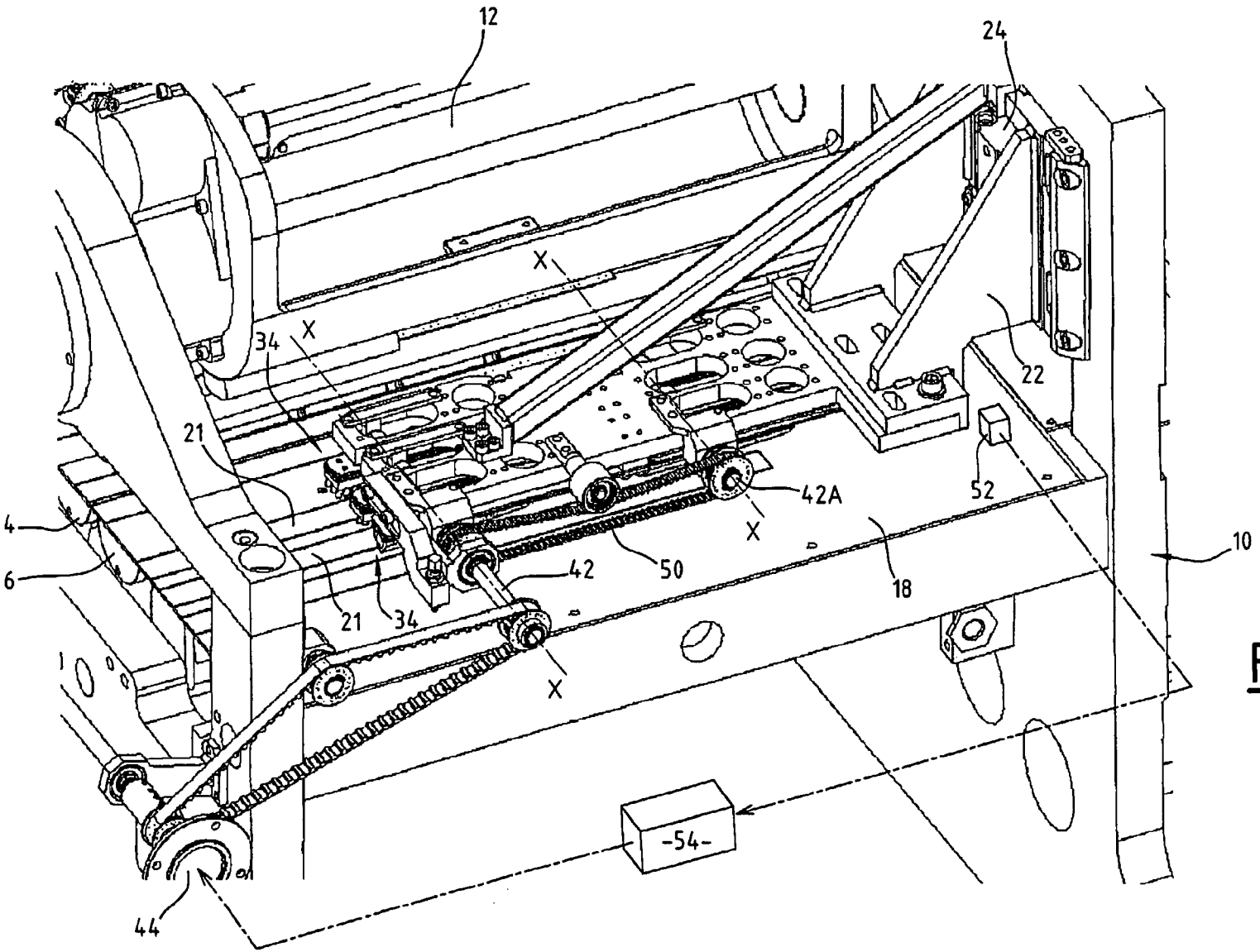
FIG. 4 is a perspective view of a variant of the folder according to the invention, the view corresponding to that of FIG. 1.

FIG. 4 shows a variant of the folder according to the invention, which differs from the folder previously described by what follows.

The cardan joint connection 46 and the motors 44 have been replaced by one single shaft 42 driven by one single motor 44, a second shaft 42A being driven by means of a toothed belt connection 50. The two shafts are fixed in translation with respect to one another. The advantage of this variant is its low cost.

What is claimed is:

1. A device for braking a flat product comprising a support;

a brake shoe for braking the flat product, the brake shoe being movable between a position allowing the passage of the flat product and a position effecting braking of the flat product, the brake shoe having a braking face, which in an installed state of the brake shoe, is directed towards the flat product to be braked and an actuating face disposed opposite the braking face, the eccentric element co-operating with the actuating face, the brake shoe including a basic body and a wear component, the wear component contacting with the eccentric element;

a drive driving the brake shoe from the passing position towards the braking position;

wherein the drive includes an eccentric element movable in rotation and co-operatable with the brake shoe.

2. The braking device as recited in claim 1 wherein the flat product is a signature.

3. The braking device according to claim 1 wherein the eccentric element is movable in rotation between a passing position corresponding to the passing position of the brake shoe and a braking position corresponding to the braking position of the brake shoe, the brake shoe being freely movable between the passing position and the braking position when the eccentric element is in the passing position.

4. The braking device according to claim 1 wherein the wear component is made from a softer material than the eccentric element.

5. The braking device according to claim 4 wherein the wear component is made from bronze.

6. The braking device according to claim 1 wherein the eccentric element is made from a harder material than the wear component.

7. The braking device according to claim 6 wherein the eccentric element is made from steel.

8. The braking device according to claim 1 further comprising means for returning the brake shoe towards the passing position.

9. The braking device according to claim 8 wherein the returning means includes a spring.

10. The braking device according to claim 8 wherein the returning means includes a leaf spring fixed to the brake shoe and to the support.

11. The braking device according to claim 1 further comprising means for driving the eccentric element in rotation.

12. The braking device according to claim 11 wherein the drive means for driving the eccentric element includes a motor and a cardan joint connection.

13. The braking device according to claim 1 wherein the eccentric element is movable in rotation about an axis of rotation, the eccentric element having an external surface, the external surface having a circular cross-section, an axis of the circle being offset from the axis of rotation.

14. The braking device according to claim 1 wherein the eccentric element is a cam having an external surface with a non-circular cross-section.

15. A folder including a chopper folding device comprising:

a folding table; and a device for braking a flat product that arrives on the folding table, comprising:

a support a brake shoe for braking the flat product, the brake shoe being movable between a position for allowing the passage of the flat product and a position effecting braking of the flat product, the brake shoe having a braking face, which in an installed state of the brake shoe, is directed towards the flat product to be braked and an actuating face disposed opposite the braking face, the eccentric element co-operating with the actuating face, the brake shoe including a basic body and a wear component, the wear component contacting with the eccentric element;

a drive driving the brake shoe from the passing position towards the braking position;

wherein the drive includes an eccentric element movable in rotation and co-operable with the brake shoe.

16. The folder according to claim 15 wherein the braking device includes a controller controlling the eccentric element suitable for braking exclusively a downstream part of a flat product to be folded.

* * * * *